United States Patent [19]

Vecchia

[11] Patent Number: 5,058,402

[45] Date of Patent: Oct. 22, 1991

[54] APPARATUS FOR THE CONTINUOUS WET TREATMENT OF WOVEN FABRIC AND KNITTED FABRICS

[75] Inventor: Gino D. Vecchia, Santorso, Italy

[73] Assignee: Sperotto Rimar S.p.A., Thiene, Italy

[21] Appl. No.: 543,374

[22] Filed: Jun. 26, 1990

[30] Foreign Application Priority Data

Jun. 27, 1989 [IT] Italy ..... 21111 A/89

[51] Int. Cl.[5] ..... D06B 1/04

[52] U.S. Cl. ..... 68/22 R; 68/43; 68/181 R

[58] Field of Search ..... 68/22 R, 205 R, 62, 68/43, 181 R; 100/163 A

[56] References Cited

U.S. PATENT DOCUMENTS

| | | | |
|---|---|---|---|
| 3,950,802 | 4/1976 | Schaffer | 68/181 R X |
| 4,004,879 | 1/1977 | Meier-Windhorst | 68/181 R X |
| 4,092,839 | 6/1978 | Banre et al. | 68/181 R X |
| 4,150,449 | 4/1979 | Talbert | 68/181 R X |
| 4,176,532 | 12/1979 | Mishima et al. | 68/181 R X |
| 4,182,140 | 1/1980 | Sando et al. | 68/181 R X |

FOREIGN PATENT DOCUMENTS

| | | | |
|---|---|---|---|
| 53-114265 | 10/1978 | Japan | 68/181 R |

OTHER PUBLICATIONS

E.P.A. 026,445 Apr. 1981.

*Primary Examiner*—Frankie L. Stinson
*Attorney, Agent, or Firm*—Charles A. Brown

[57] ABSTRACT

An apparatus for the continuous wet treatment of woven fabrics and knitted fabrics comprising a casing providing with an entry slot and an exit slot for the fabric under treatment, a curved widening cylinder, a series of rollers covered with a rubber layer with their axes parallel and transverse to the fabric feed path, the rollers being arranged in zig-zag formation in a vertical plane one in contact with the next. The series of rollers comprises in succession idle rollers, presser rollers and a motorized roller. The apparatus also comprises a squeezing roller positioned in proximity to said exit slot in contact with the motorized roller. There are also provided devices for adjusting the contact pressure between the presser rollers and their adjacent rollers and between said squeezing roller and its adjacent roller, and pairs of scraper seals positioned against the side ends of each mutually contacting roller pair of said series. Finally, there are provided two treatment liquid feed pipes in the top of the casing in positions corresponding with two different contact regions between the rollers, and a treatment liquid discharge pipe.

7 Claims, 5 Drawing Sheets

APPARATUS FOR THE CONTINUOUS WET TREATMENT OF WOVEN FABRIC AND KNITTED FABRICS

This invention relates to an apparatus for the continuous wet treatment of woven fabrics and knitted fabrics.

The object of the invention is to provide an apparatus for the continuous liquid treatment of woven fabrics and knitted fabrics both in open width and in tubular form able to prevent any tension arising in the fabric under treatment by comprising means for monitoring and compensating any tension present, and also provided with suitable adjustable spray and squeezing-out elements.

This object is attained according to the invention by an apparatus for the continuous wet treatment of woven fabrics and knitted fabrics comprising a parallelepiped casing provided with an entry slot and an exit slot for the fabric under treatment; a curved widening cylinder positioned in proximity to said entry slot; a series of rollers covered with a rubber layer and rotating about mutually parallel axes transverse to the fabric feed path and arranged in zig-zag formation in a vertical plane one in contact with the next, said series of rollers comprising in succession at least one idle roller, at least one presser roller and a motorized roller; a squeezing roller identical to the rollers of said series and positioned in proximity to said exit slot in contact with said motorized roller; devices for adjusting the contact pressure between said at least one presser roller and its adjacent rollers and between said squeezing roller and its adjacent roller; pairs of scraper seals positioned against the side ends of each mutually contacting roller pair of said series; two treatment liquid feed pipes in positions corresponding with two contact regions between said rollers of said series, said contact regions being different and oppositely positioned in said casing, and finally a treatment liquid discharge pipe.

Advantageously, by increasing the number of idle rollers and presser rollers a versatile apparatus or modular unit can be constructed which is universally suitable for any treatment of any type of fabric.

By combining two or more connectable modular units a universal treatment line for fabrics can be formed.

Moreover, advantageously an apparatus composed of modules possesses a sequence and a plurality of impregnation and squeezing-out stages arranged to effect a corresponding number of countercurrent treatments on the fabric within an extremely small overall space.

In this respect, such an apparatus can be used for washing a fabric with water and/or impregnating it with any treatment liquid, its formation being such as to allow of any type of continuous fabric, whether woven or knitted, in open width or tubular form.

The structural and operational characteristics of a continuous wet treatment apparatus for fabrics according to the present invention will be more apparent from the description given by way of nonlimiting example with reference to the accompanying schematic drawings in which.

Figure 1:
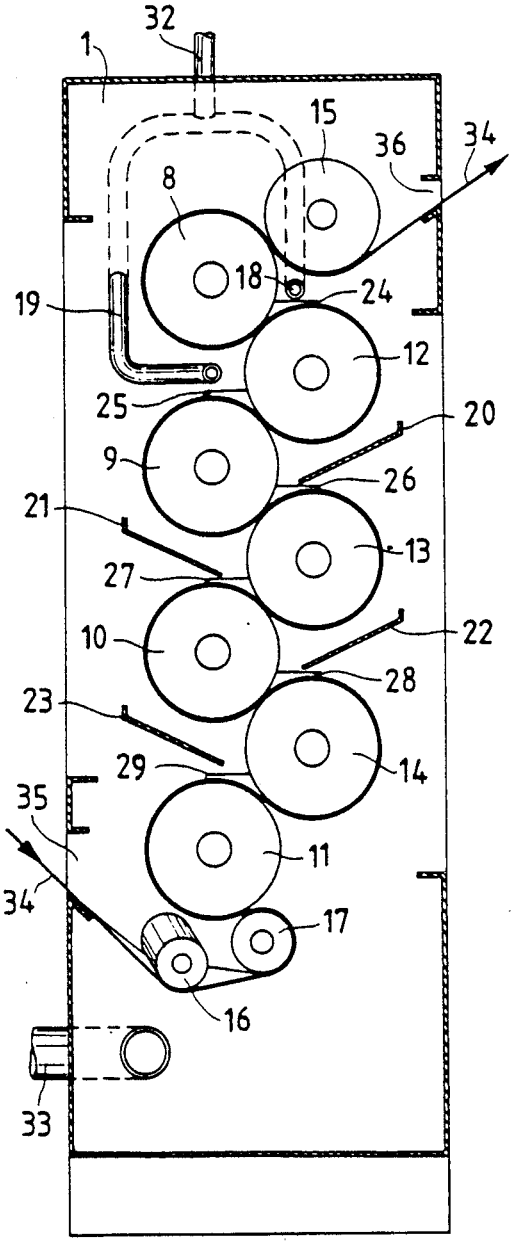
FIG. 1 is a longitudinal sectional elevation of a first embodiment of the apparatus according to the invention.
Figure 4:
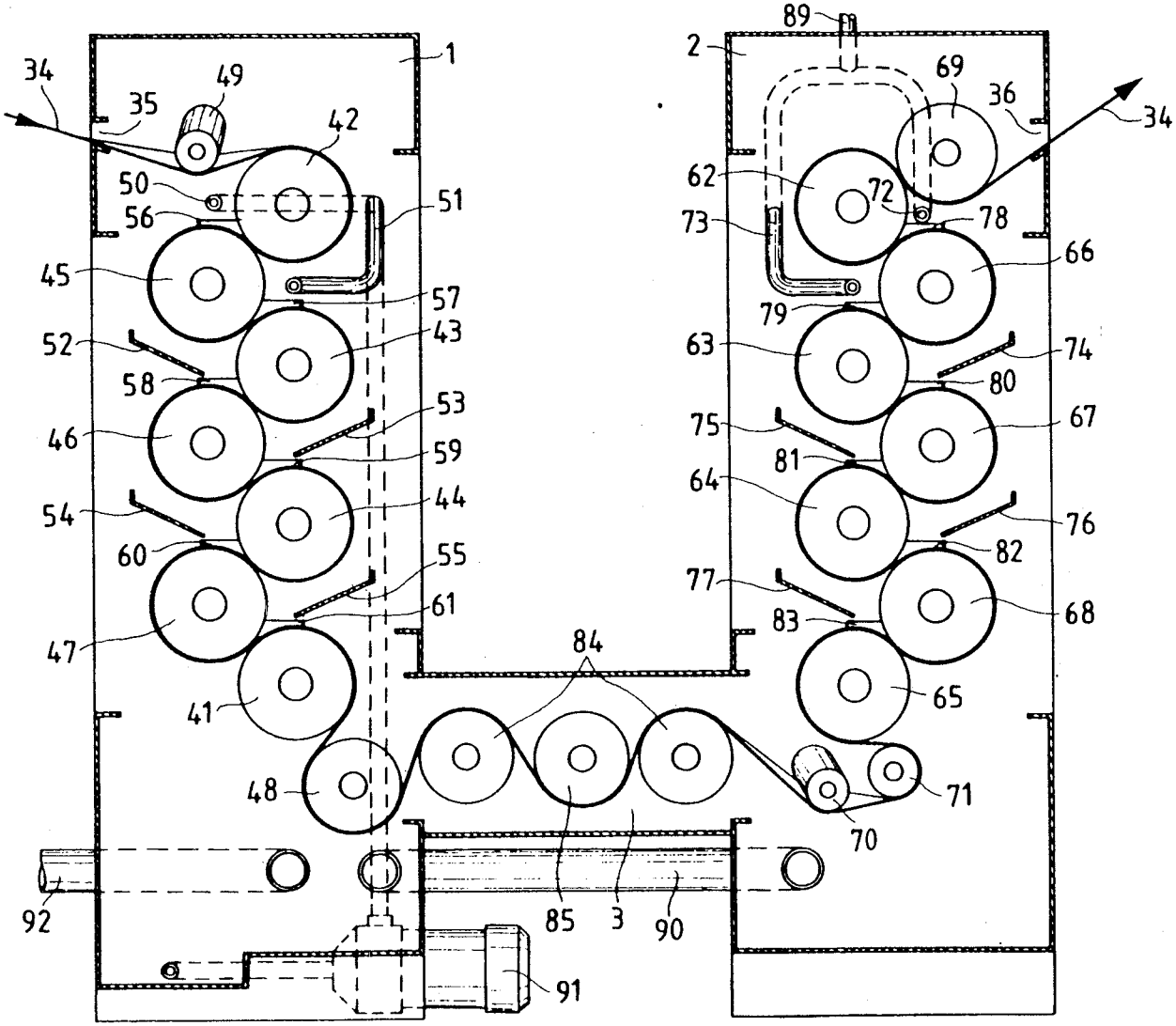
FIG. 4 is a longitudinal sectional elevation of a third embodiment of an apparatus according to the present invention.
Figure 6:
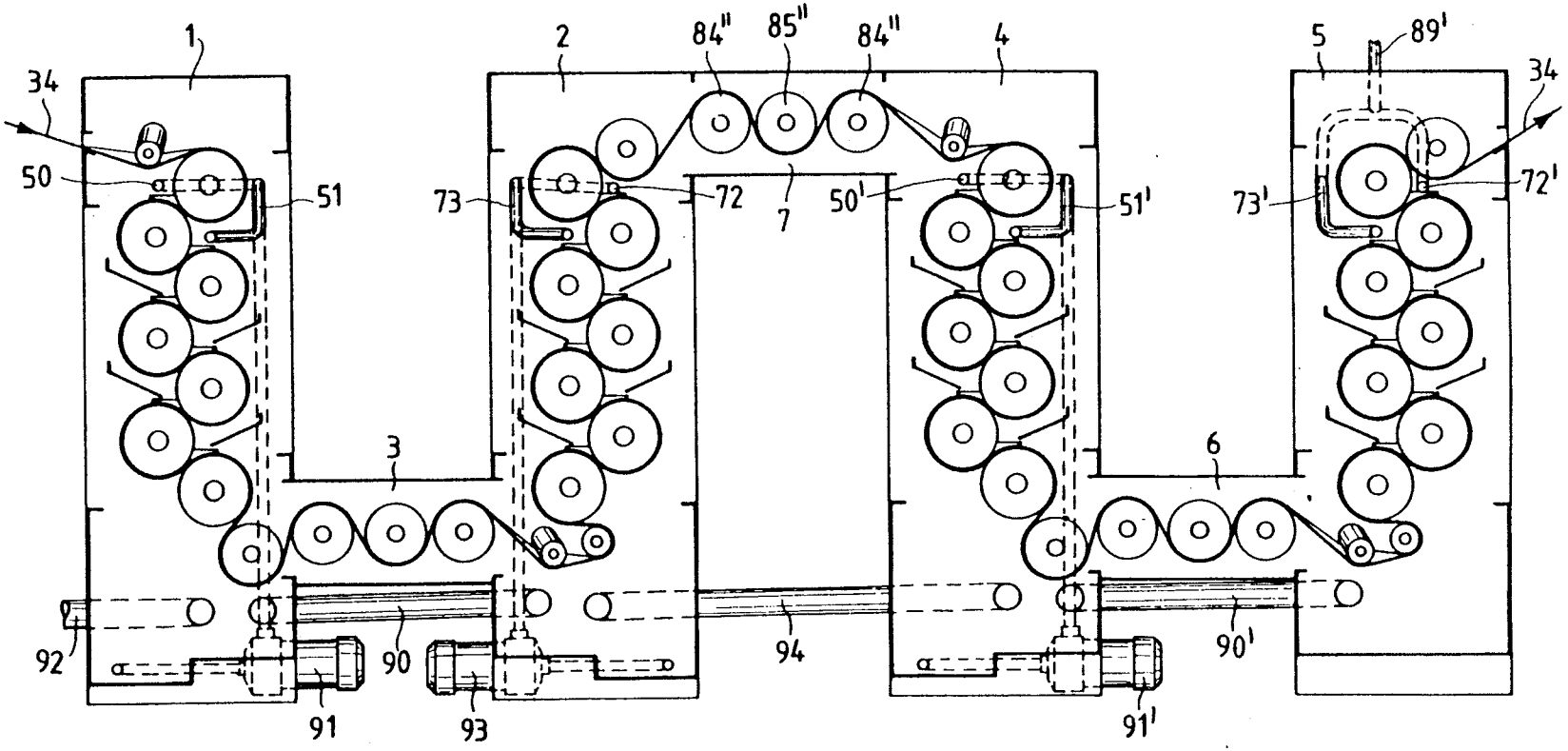

FIG. 6 is a longitudinal sectional elevation of a fourth embodiment of an apparatus formed by combining two units similar to that FIG. 4. A first embodiment of the apparatus according to the present invention consists essentially of a parallelepiped casing 1 comprising a lower entry slot 35 and an upper exit slot 36 for a fabric 34 under treatment. The casing 1 houses, in the feed direction of the fabric 34 which in the particular example of FIG. 1 is from the bottom upwards, a curved widening cylinder 16, an idle deviation roller 17, a series of rollers described specifically hereinafter, and finally a squeezing roller 15 covered with a layer of special rubber.

Said series of rollers, comprising a surface covering in the form of a rubber layer, rotate about mutually parallel axes transverse to the feed path of the fabric 34, the rollers being positioned in a zig-zag arrangement in a vertical plane and in contact with each other, to comprise three idle rollers 9, 10, 11 and three presser rollers 12, 13, 14, offset relative to the preceding and in contact with them, plus an upper motorized roller 8. This described roller assembly is arranged in succession within the casing as stated, with the widening cylinder 16, in a zig-zag arrangement such that one is in contact with the next until the squeezing roller 15 is reached, this feeding the fabric 34 to the exit slot 36.

Two treatment liquid spray pipes 18, 19 are positioned to correspond with two contact regions, the first being defined between the motorized roller 8 and an upper presser roller 12 and the second between this latter and the idle roller 9, said regions being positioned opposite each other in the upper part of the casing.

There are also provided four conveyor elements 20, 21, 22, 23 for the treatment liquid and six pairs of scraper seals 24, 25, 26, 27, 28, 29 against the two side ends of each pair of mutually contacting rollers, ie the pairs 8, 12; 12,9; 9,13; 13,10; 10,14; and 14,11 respectively.

Figure 2:
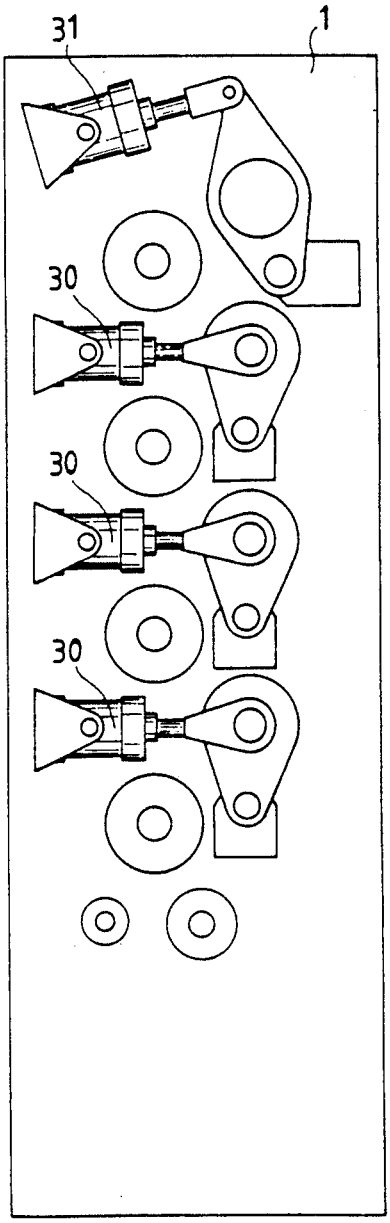
FIG. 2 is a longitudinal side elevation of the apparatus of FIG. 1.

Externally the apparatus also comprises (FIG. 2), on its side, pneumatic devices 30 for adjusting the compressive pressure of the presser rollers 12, 13, 14 and a further pneumatic device 31 for adjusting the squeezing pressure of the squeezing roller 15 against their adjacent rollers. Finally, the apparatus comprises (shown dashed and dotted in FIG. 1) a pipe 32 for feeding the treatment liquid to two spray pipes 18, 19, and a pipe 33 for discharging the treatment liquid which collects on the base of the casing.

During operation, the fabric 34 is continuously fed into the casing 1 through the entry slot 35, opened out by the curved widening cylinder 16, deviated by the idle roller 17 and conveyed without tension by the assembly of idle rollers 9, 10, 11, presser rollers 12, 13, 14, the upper motorized roller 8 and the squeezing roller 15 along a path which at least partly embraces said rollers in zig-zag arrangement, to ascend towards the top of the casing 1, during which it is subjected to a sequence of treatment liquid impregnation stages and compression stages until it leaves the casing 1 through the slot 36.

The purpose of the two treatment liquid spray pipes 18, 19 which are fed by the pipe 32 and positioned to correspond with the two compression regions formed by the roller pairs 8, 12 and 12, 9 respectively is to provide a cascade of treatment liquid which is collected by the four underlying conveyor elements 20, 21, 22, 23 in positions corresponding with the subsequent four compression regions formed by the presser roller pairs 9, 13; 13, 10; 10, 14; and 14, 11 respectively. Each of said six compression regions defines a reservoir formed by portions of the longitudinal surfaces of each pair of mutually contacting rollers 8, 12; 12, 9; 9, 13; 13, 10; 10, 14; and 14, 11 respectively and by the corresponding lateral scraper seal pairs 24, 25, 26, 27, 28, 29 respectively.

In each of said six compression regions—and in particular within each of said six reservoirs—there is thus formed an accumulation of treatment liquid which engages the fabric 34, said liquid being partly removed from the fabric 34 by the effect on the compression and flowing along the longitudinal surface of the lower roller to be collected by the underlying conveyor, which itself expels the liquid in the compression region, and particularly in the reservoir, corresponding with it. In this manner a new accumulation of treatment liquid forms in each of the underlying compression regions and particularly within each of said reservoirs, said liquid again engaging the fabric 34 and so on until the treatment liquid falls onto the base of the casing 1, and is discharged therefrom via the pipe 33.

In this manner a flow of treatment liquid is created which is countercurrent to the feed of the fabric 34 in that the liquid flows from the top to the bottom of the casing 1 whereas the fabric 34 flows in the opposite direction from the bottom upwards. Moreover, during its ascending path within the casing 1 the fabric 34 is subjected to a sequence of impregnations with increasingly cleaner treatment liquid.

As already stated, the apparatus according to the present invention can be used for impregnating a fabric with a treatment liquid, such as an aqueous caustic soda solution for soda treatment or mercerization purposes. Alternatively it can be used as a wash unit, in which case the treatment liquid is water, with detergent products either added or not. In all cases said apparatus is able to treat both woven fabric and knitted fabric. The new method proposed by the present invention consists mainly of bring into mutual contact, in a vertical zig-zag formation, rollers which simultaneously perform the following three essential functions:

conveying the fabric without tension in that it is continuously accompanied by the rollers;

adjustably compressing the fabric at this points of contact with the rollers; and forming a reservoir for containing the treatment liquid in each compression region between two consecutive rollers for the impregnation of the fabric. Advantageously, in the apparatus of the invention motion is transmitted to all the constituent rollers of the "column" by a single motorized roller 8, although it is possible to motorize some or all of the idle rollers 9, 10, 11 if particular requirements related to the type of treatment, the characteristics of the fabric to be treated or the apparatus dimensions demand it.

The apparatus is further characterised in that:

the intermediate rollers 9, 10, 11, 12, 13, 14 of the "column" each have two points of contact with the adjacent rollers to thus each form two compression regions and two corresponding reservoirs for containing the treatment liquid, and the vertical zig-zag formation of the rollers enables a large number of impregnation and compression regions for the fabric to be achieved within a very small space. In this manner it is also possible to treat the fabric countercurrently with a series of "baths" so allowing considerable utilization of the treatment liquid and consequently a large saving in fresh treatment liquid consumption.

In this respect, it should be noted that the number of fabric impregnation and compression regions and thus the number of rollers and consequently the height of the "column" can be decreased or increased relative to that described and illustrated in FIG. 1 without leaving the scope of the invention.

These elements are of fundamental importance to the operation of the apparatus. When this is used as a fabric impregnation unit for soda and/or mercerization treatment, the effectiveness and uniformity of the fabric impregnation is greater the greater the number of fabric impregnation and squeezing-out stages. When however the apparatus is used as a washing unit, its effectiveness is a direct function of the number of impregnations and squeezings to which the fabric is subjected and is greater the squeezing pressure on the fabric, so increasing the liquid change through it. For this purpose the presser rollers 12, 13, 14 and the final squeezing roller 15 are provided respectively with pneumatic devices 30 for adjusting the compressive pressure, and with pneumatic devices 31 for adjusting the final squeezing pressure. A further characteristic of the apparatus according to the invention is its modularity, i.e. possibility of connecting two or more "units" together in various ways to form a countercurrent treatment line.

Figure 3:
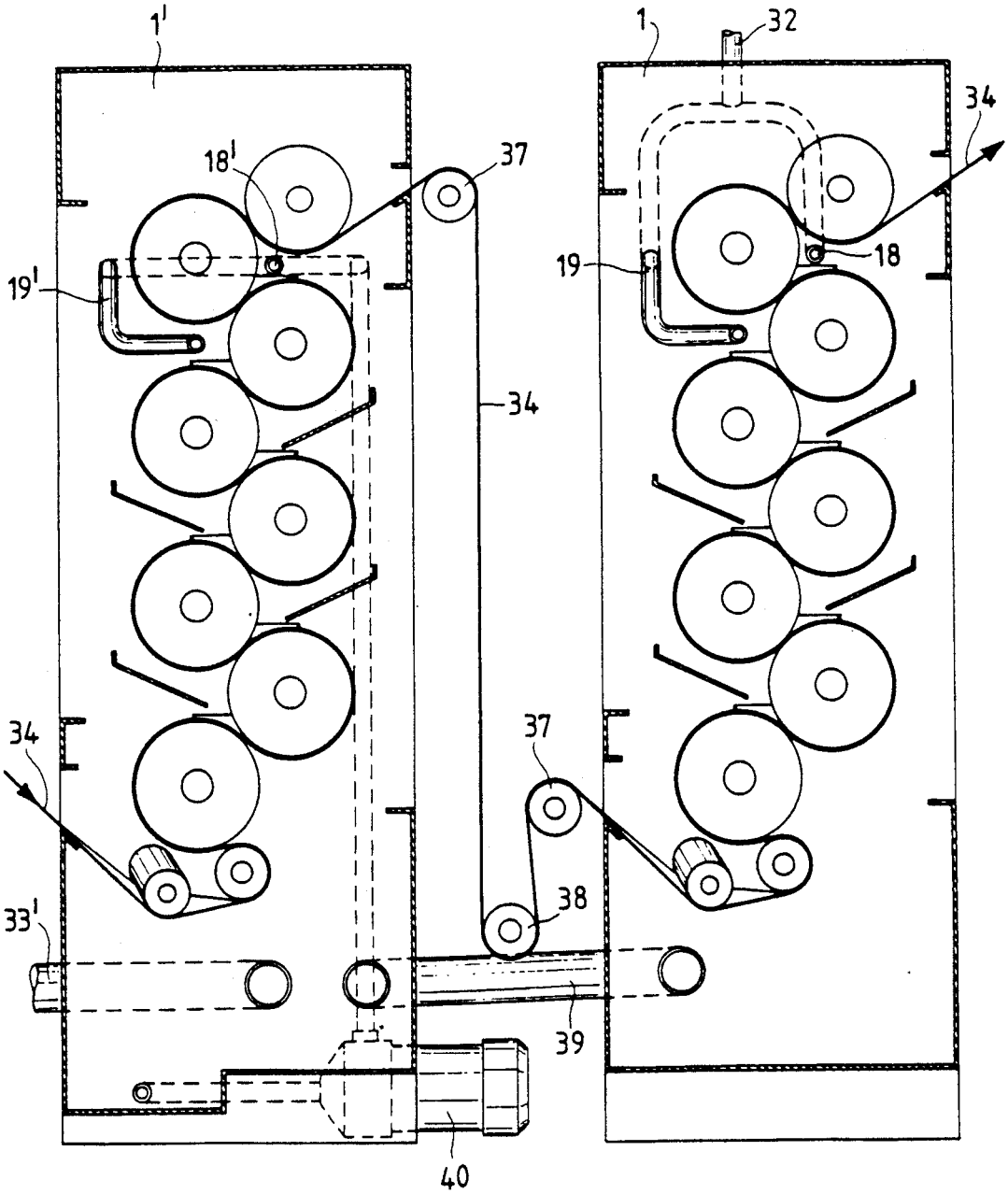
FIG. 3 is a longitudinal sectional elevation of a second embodiment of an apparatus formed by combining two units similar to that FIG. 1.

The most simple configuration is that shown by way of example in FIG. 3, which shows the combination of two "units" identical to that described with reference to FIG. 1, they being connected together via two idle deviation rollers 37 and a floating tension compensation roller 38 which accompany the fabric 34 during its passage from one of said two treatment "units" to the other.

In this case, in which the two casings are indicated by 1 and 1', the liquid flow passes from the casing 1 to the casing 1' via a passage pipe 39 (FIG. 3) between the base of the casing 1 and the base of the casing 1'. The casing 1' is also provided with a pump 40, shown partially, which draws treatment liquid from the base of said casing 1' and recycles it to the respective spray pipes 18', 19' at the top of the casing, and with a pipe 33', shown by dashed lines, for discharging excess treatment liquid from the base of the casing 1'. Such a configuration is particularly suitable for treating woven fabrics.

A further method of combining two treatment "units" is shown in FIG. 4. In this case the treatment "assembly" consists essentially of first casing 1, a second casing 2 and a connection tunnel 3 between the casings 1 and 2.

The casing 1 houses from the top downwards, starting from the entry slot 35, curved widening cylinder 49, a series of rollers comprising three idle rollers 42, 43, 44 alternating with three presser rollers 45, 46, 47, and a lower motorized roller 41, all covered with a layer of special rubber and positioned in zig-zag arrangement with one in contact with the next respectively to rotate about their longitudinal axis, plus a friction roller 48.

Two spray pipes 50, 51 for the treatment liquid are positioned at the first presser roller 45 and at the second idle roller 43, there being also provided conveyor elements 52, 53, 54, 55 for the treatment liquid and six pairs of scraper seals 56, 57, 58, 59, 60, 61 against the two side ends of each pair of mutually contacting rollers, namely 42, 45; 45, 43; 43, 46; 46, 44; 44, 47; and 47, 41 respectively.

As in the previous examples, each compression region resulting from the mutually contacting rollers defines a reservoir formed from portions of the longitudinal surfaces of each pair of mutually contacting rollers and the corresponding pair of lateral scraper seals.

The casing 2 houses an arrangement identical to that shown in FIG. 1. Specifically, from the bottom upwards it houses a curved widening cylinder 70, an idle roller 71, a series of rollers comprising three idle rollers 63, 64, 65 alternating with three presser rollers 66, 67, 68, an upper motorized roller 62 and finally a squeezing roller 69. There are also provided two treatment liquid spray pipes 72, 73, four conveyor elements 74, 75, 76, 77 for the treatment liquid, and six pairs of scraper seals 78, 79, 80, 81, 82, 83 against the two side ends of each pair of contacting rollers.

The connection tunnel 3 houses two friction rollers 84 and a floating tension compensation roller 85.

Figure 5:
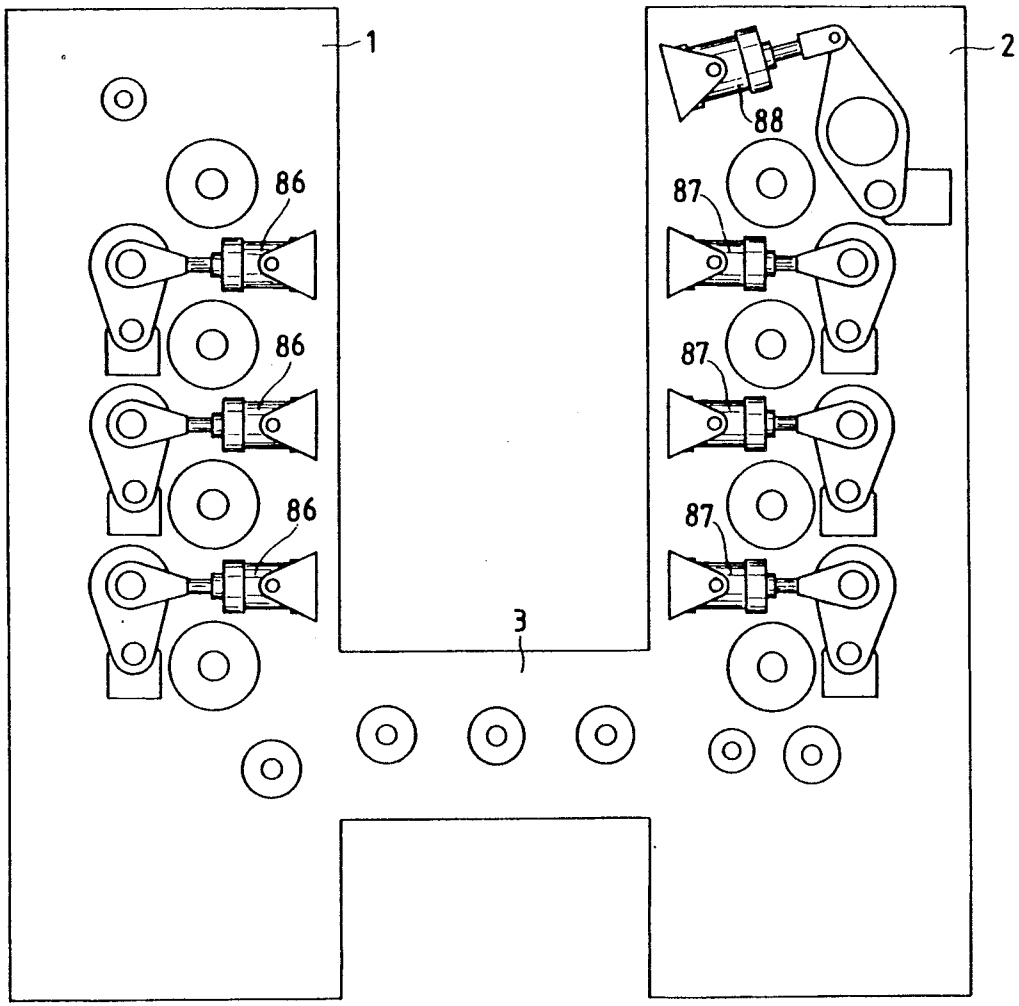
FIG. 5 is a longitudinal side elevation of the apparatus of FIG. 4.

Again in this case the treatment "assembly" also comprises (FIG. 5) pneumatic devices 86, 87 for adjusting the compressive pressure of the presser rollers 45, 46, 47 and 66, 67, 68 respectively, and a further pneumatic device 88 for adjusting the squeezing pressure of the squeezing roller 69.

Finally, the treatment "assembly" comprises (FIG. 4, shown by dashed lines) a pipe 89 connected to the casing 2 for feeding the treatment liquid to the spray pipes 72, 73, a pipe 90 for the passage of treatment liquid from the base of the casing 2 to the base of the casing 1, a pump 91 for drawing treatment liquid from the base of the casing 1 and recycling it to the respective spray pipes 50, 51 at the top of the same casing, and a pipe 92 for discharging excess treatment liquid from the base of the casing 1.

During operation, the fabric 34 is fed continuously into the casing 1 via the entry slot 35, opened out by the curved widening cylinder 49 and conveyed without tension by the assembly of idle rollers 42, 43, 44, the presser rollers 45, 46, 47 and the lower motorized roller 41 along a path which at least partly embraces said zig-zag rollers in descending towards the base of the casing 1, during which it is subjected to a sequence of impregnations with the treatment liquid plus compression. The fabric 34 is then accompanied by the friction rollers 48 and 84 and tension-controlled by the floating compensation roller 85 during its conveying through the tunnel 3 which connects to the casing 2, in which after again being opened out by the curved widening cylinder 70 and deviated by the idle roller 71, it proceeds along its embracing zig-zag path upwards towards the top of the casing 2, conveyed without tension by the assembly of idle rollers 63, 64, 65, presser rollers 66, 67, 68, the upper motorized roller 62 and the squeezing roller 69, to be again subjected to a sequence of impregnations with the treatment liquid plus compression until it leaves the casing 2 via the slot 36.

The treatment liquid, fed via the pipe 89 to the spray pipes 72, 73 at the top of the casing 2, flows (as already described for the apparatus shown in FIG. 1) towards the base of the casing 2 in countercurrent with the advancement of the fabric 34 and flows from the base of the casing 2 via the passage pipe 90 to the base of the casing 1, from which it is drawn by the pump 91 which recycles it to the spray pipes 50, 51 at the top of the casing 1, to then flow to the base of the casing 1. From here the excess treatment liquid is discharged via the pipe 92.

Such a treatment "assembly" is particularly suitable for treating knitted fabric because of the special system for accompanying the fabric 34 without tension during its passage from the casing 1 to the casing 2 through the connection tunnel 3.

Finally, FIG. 6 shows very schematically the combination of two treatment "assemblies" identical to that described with reference to FIG. 4, each of said two "assemblies" consisting respectively of casings 1 and 2 and the relative connection tunnel 3, and casings 4 and 5 and the relative connection tunnel 6, said two treatment "assemblies" being connected together by a further connection tunnel 7.

Said connection tunnel 7 contains two friction rollers 84'' and a floating tension compensation roller 85'', said rollers accompanying the fabric 34 during its passage from the casing 2 to the casing 4.

The path of the fabric 34 within the said two treatment "assemblies" is identical to that described for the treatment "assembly" shown in FIG. 4.

In this case the treatment liquid is fed through the pipe 89' connected to the spray pipes 72', 73' in the casing 5. Within each treatment "assembly", the treatment liquid passes through the pipe 90' between the base of the casing 5 and the base of the casing 4 and through the pipe 90 between the base of the casing 2 and the base of the casing 1. The treatment liquid passes between the two said treatment "assemblies" via the pipe 94 between the base of the casing 4 and the base of the casing 2. The casing 1, 2 and 4 are each provided with a pump. 91, 93 and 91' respectively, for recycling treatment liquid from the base of said casings 1, 2 and 4 to the spray pipes 50, 51; 72, 73; and 50', 51' respectively. The casing 1 is provided at its base with a pipe 92 for discharging excess treatment liquid.

I claim:

1. An apparatus for continuous wet treatment of woven fabrics and knitted fabrics comprising a parallelepiped casing provided with an entry slot and an exit slot for the fabric under treatment; a curved widening cylinder positioned in proximity to said entry slot; a series of rollers covered with a rubber layer and rotating about mutually parallel axes transverse to the fabric feed path and arranged in zig-zag formation in a vertical plane one in contact with the next, said series of rollers comprising in succession at least one idle roller, at least one presser roller and a motorized roller; a squeezing roller identical to the rollers of said series and positioned in proximity to said exit slot in contact with said motorized roller; devices for adjusting the contact pressure between said at least one presser roller and its adjacent rollers and between said squeezing roller and its adjacent roller; pairs of scraper seals positioned against the side ends of each mutually contacting roller pair of said series; two treatment liquid feed pipes in positions corresponding with two contact regions between said rollers of said series, said contact regions being different and oppositely positioned in said casing, and finally a treatment liquid discharge pipe.

2. An apparatus as claimed in claim 1, characterised by comprising at least one idle deviation roller positioned downstream of said widening cylinder, which is in contact with said at least one idle roller.

3. An apparatus as claimed in claim 1 characterised in that said at least one idle roller and at least on presser roller are a plurality of rollers which mutually alternate and are provided with elements for conveying treatment liquid towards their transverse compression regions of mutual contact, where there are also provided, against their side ends, pairs of scraper seals which define reservoir regions for containing said liquid.

4. An apparatus as claimed in claim 1, characterised in that said entry slot and said exit slot are positioned respectively at the bottom and top of said casing, said two liquid feed pipes being positioned at the top of said casing to create a treatment liquid flow in countercurrent to the direction of advancement of the fabric.

5. An apparatus as claimed in claim 1 characterised by comprising two casings positioned one after the other, there being interposed therebetween at least one deviation roller and a tension compensation for the fabric leaving one casing and entering the other, there being provided a connection pipe between the bases of said two casings, and a pump which draws liquid from the base of one of said two casings and feeds it directly to the two feed pipes of the same casing.

6. An apparatus as claimed in claim 1, characterised in that a connection tunnel extends from said entry slot at the base of said casing to an exit slot of a second casing, this latter comprising an entry slot at its top, said connection tunnel housing a pair of friction rollers between which a tension compensation roller is provided, there being also provided a connection pipe between said two casings, a further friction roller and a pump in said second casing to draw liquid from the base and recycle it directly to the feed pipes of this latter casing, said squeezing roller being provided only at the exit slot of said first casing.

7. An apparatus as claimed in claim 6, characterised in that more than one pair of casings as described in the preceding claim are associated with each other.

* * * * *